US010242521B2

(12) United States Patent
Weng et al.

(10) Patent No.: US 10,242,521 B2
(45) Date of Patent: Mar. 26, 2019

(54) PAPER MONEY RECYCLING BIN AND PAPER MONEY PROCESSING DEVICE

(71) Applicant: GRG BANKING EQUIPMENT CO., LTD., Guangzhou, Guangdong (CN)

(72) Inventors: Qiuhua Weng, Guangdong (CN); Dong Tan, Guangdong (CN)

(73) Assignee: GRG BANKING EQUIPMENT CO., LTD., Guangzhou, Guangdong (CN)

( * ) Notice: Subject to any disclaimer, the term of this patent is extended or adjusted under 35 U.S.C. 154(b) by 0 days.

(21) Appl. No.: 15/510,555

(22) PCT Filed: Aug. 24, 2015

(86) PCT No.: PCT/CN2015/087900
§ 371 (c)(1),
(2) Date: Mar. 10, 2017

(87) PCT Pub. No.: WO2016/045476
PCT Pub. Date: Mar. 31, 2016

(65) Prior Publication Data

US 2017/0309110 A1 Oct. 26, 2017

(30) Foreign Application Priority Data

Sep. 24, 2014 (CN) ..... 2014 1 0494468

(51) Int. Cl.
*B65H 1/28* (2006.01)
*G07D 11/00* (2006.01)

(52) U.S. Cl.
CPC ..... *G07D 11/0012* (2013.01); *B65H 1/28* (2013.01); *G07D 11/0006* (2013.01);
(Continued)

(58) Field of Classification Search
CPC ..... G07D 11/0006; B65H 1/28
See application file for complete search history.

(56) References Cited

U.S. PATENT DOCUMENTS 5,332,209 A * 7/1994 Romansky ..... B65H 1/04 271/171
6,481,620 B1 11/2002 Katou et al.
(Continued)

FOREIGN PATENT DOCUMENTS

CN 2240745 Y 11/1996
CN 1312522 A 9/2001
(Continued)

OTHER PUBLICATIONS

International Search Report for PCT/CN2015/087900, dated Dec. 3, 2015, ISA/CN.

*Primary Examiner* — Luis A Gonzalez
(74) *Attorney, Agent, or Firm* — U.S. Fairsky LLP; Yue (Robert) Xu

(57) ABSTRACT

A paper money recycling bin and paper money processing device; the paper money recycling bin includes a box and a partition plate installed in the box; symmetrical vertical groove groups are provided on a left inner wall and a right inner wall of the box; each vertical groove group includes a plurality of vertical grooves; and a left edge and a right edge of the partition plate are inserted in the vertical grooves to partition the internal space of the box, thus preventing a gap in the space, and avoiding the situation of tilting, irregular stacking or jamming when paper money subsequently enters.

14 Claims, 5 Drawing Sheets

(52) U.S. Cl.
CPC ..... *G07D 11/0021* (2013.01); *G07D 11/0081* (2013.01); *G07D 11/0093* (2013.01)

(56) References Cited

U.S. PATENT DOCUMENTS

| | | | | |
|---|---|---|---|---|
| 6,546,881 | B1 | 4/2003 | Wiesner | |
| 7,516,956 | B2 * | 4/2009 | Allwright | B65H 1/04 271/171 |
| 8,430,396 | B2 * | 4/2013 | Holland-Letz | G07D 11/0012 271/145 |
| 2011/0036731 | A1 | 2/2011 | Bortz | |
| 2012/0175217 | A1 | 7/2012 | Demmeler | |
| 2012/0255829 | A1 | 10/2012 | Togiya | |

FOREIGN PATENT DOCUMENTS

| | | | | |
|---|---|---|---|---|
| CN | 2620330 | Y | 6/2004 | |
| CN | 201181493 | Y | 1/2009 | |
| CN | 201397535 | Y | 2/2010 | |
| CN | 101894417 | A | 11/2010 | |
| CN | 101970302 | A | 2/2011 | |
| CN | 201838071 | U | 5/2011 | |
| CN | 102656611 | A | 9/2012 | |
| CN | 102667878 | A | 9/2012 | |
| CN | 103168318 | A | 6/2013 | |
| CN | 103366442 | A | 10/2013 | |
| CN | 103824392 | A | 5/2014 | |
| CN | 104240383 | A | 12/2014 | |
| EP | 2053572 | A2 | 4/2009 | |
| GB | 2343441 | A | 5/2000 | |
| WO | WO-2014075626 | A1 * | 5/2014 | G07D 11/0009 |
| WO | WO-2014102105 | A1 * | 7/2014 | G07D 11/0006 |

* cited by examiner

PAPER MONEY RECYCLING BIN AND PAPER MONEY PROCESSING DEVICE

This application is the national phase of International Application No. PCT/CN2015/087900, titled "PAPER MONEY RECYCLING BIN AND PAPER MONEY PROCESSING DEVICE", filed on Aug. 24, 2015, which claims the benefit of priority to Chinese patent application No. 201410494468.0 titled "BANKNOTE RECYCLING BOX AND BANKNOTE PROCESSING DEVICE", filed with the Chinese State Intellectual Property Office on Sep. 24, 2014, the entire disclosures of which are incorporated herein by reference.

FIELD

The present application relates to the technical field of financial equipment, in particular to a banknote recycling box and a banknote processing device.

BACKGROUND

With the continuous development of economy, the processing amount of banknotes is continuously increased, and the requirement for processing capacity of the banknote processing device is increased accordingly. The existing banknote processing devices commonly used mainly include an automatic teller machine, a banknote sorter and so on. In these devices, a banknote recycling box is widely used for accommodating unqualified banknotes (waste banknotes) identified by a banknote identification mechanism and banknotes forgotten to be taken (recycling) after being dispensed.

Generally, a fixed partition plate is provided in a recycling box to divide an inner space of the box into two parts, including a waste banknote part and a forgotten banknote recycling part. Since the inner space generally has a fixed size, an undersize banknote stored in the recycling box may generate a large gap in the storage space, and a subsequent banknote is apt to enter the gap, thus the banknote may be inclined and erected and may collide with following banknotes, which leads to disordered stacking of the banknotes and banknote jamming. An issue faced by the banknote recycling box currently is to ensure that the banknotes entered the recycling box can be orderly stacked and to prevent the subsequently entered banknotes from colliding with the banknotes already in the recycling box.

SUMMARY

A banknote recycling box and a banknote processing device are provided according to embodiments of the present application, which can prevent a gap in the space and avoid situations that subsequent banknotes are inclined and erected, and banknotes are disorderly stacked or jammed.

A banknote recycling box according to an embodiment of the present application includes a box body and a partition plate installed in the box body; a left inner wall and a right inner wall of the box body are provided with symmetrical vertical groove groups, and each of the vertical groove groups includes a plurality of vertical grooves; and a left edge and a right edge of the partition plate are inserted into the vertical grooves to divide an inner space of the box body.

Optionally, a label is provided at a position adjoining to each of the vertical groove groups, and the label is marked with a corresponding relationship between the respective vertical groove of the vertical groove group and a width of a banknote.

Optionally, the number of the partition plate is two.

Optionally, the box body is divided into an upper box body and a lower box body; inner walls of the upper box body and the lower box body are both provided with ribs; and an upper edge and a lower edge of the partition plate are provided with grooves configured to cooperate with the respective ribs.

Optionally, the ribs of the upper box body are asymmetrically arranged in a left and right direction; or, the ribs of the lower box body are asymmetrically arranged in the left and right direction.

Optionally, one side of the partition plate is provided with a tooth-shaped area, and tooth-shaped structures of the tooth-shaped area are parallel to a bottom of the box body.

Optionally, a plurality of inner spaces in the box body divided by the partition plate are not in communication with each other.

Optionally, a top of the box body is provided with a plurality of banknote entrances.

Optionally, a banknote entrance door is provided on the banknote entrance; and one side of the box body is provided with a lever, and the lever is connected to the banknote entrance door and is configured to open the banknote entrance door when the lever is trigged.

A banknote processing device according to an embodiment of the present application includes a banknote inlet, a banknote conveying passage, a lower conveying passage and a plurality of banknote boxes, and further includes any one of the above-mentioned banknote recycling boxes.

According to the above technical solutions, the embodiments of the present application have the following advantages.

In the embodiment of the present application, a banknote recycling box includes a box body and a partition plate installed in the box body. A Left inner wall and a right inner wall of the box body are provided with symmetrical vertical groove groups, and each of the vertical groove groups includes multiple vertical grooves. A left edge and a right edge of the partition plate are inserted into the vertical grooves, to divide an inner space of the box body. In the embodiment of the present application, the position of the partition plate in the box body may be adjusted by inserting the partition plate in different vertical grooves in the vertical groove group, and therefore the spaces of a waste banknote portion and a forgotten recycling portion in the banknote recycling box can be adjusted. And, after a banknote with a small size enters a suitable storage space after being adjusted, no gap will occur in the storage space, thereby avoiding a situation that subsequent banknotes are inclined and erected when enter the storage space, and banknotes are disorderly stacked or jammed.

DETAILED DESCRIPTION

A banknote recycling box and a banknote processing device are provided according to embodiments of the present application, which can prevent a gap in the space and avoid situations that subsequent banknotes are inclined and erected, and banknotes are disorderly stacked or jammed.

For the purposes, features and advantages of the present application to be more obvious and better understood, the technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the scope of protection of the present application.

Figure 1:
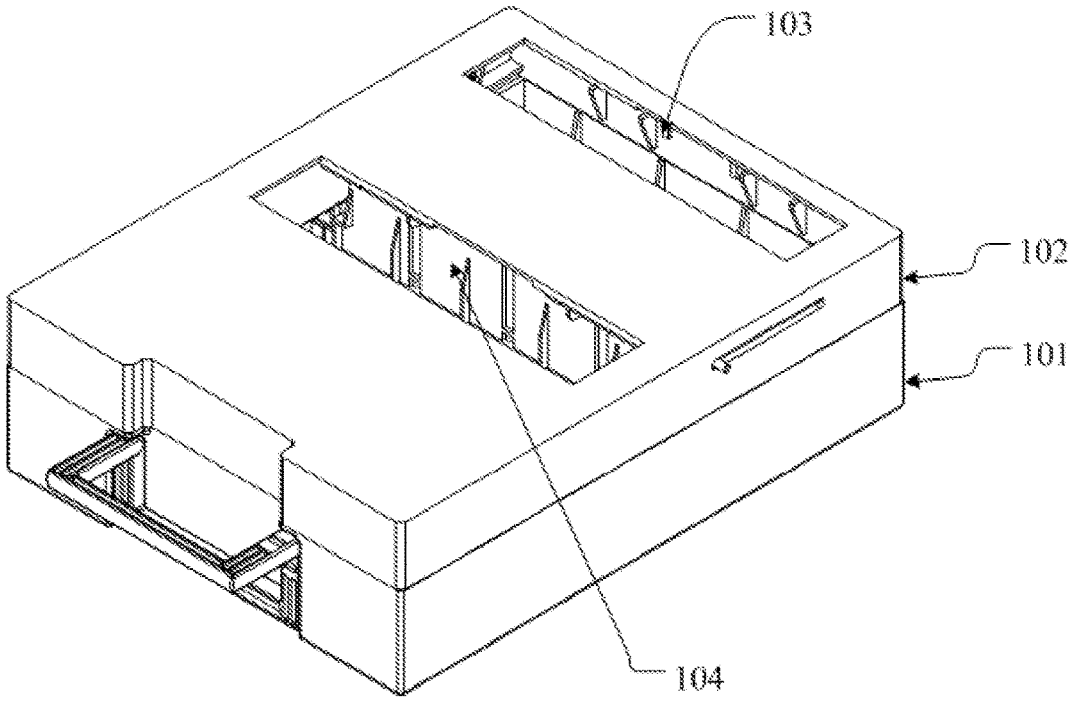
FIG. 1 is a schematic view showing the structure of a banknote recycling box according to an embodiment of the present application.

FIG. 1 shows an appearance of a banknote recycling box according to an embodiment of the present application. The banknote recycling box includes a lower box body 101, an upper box body 102, a waste banknote entrance 103, and a forgotten banknote recycling entrance 104 and so on.

Figure 2:
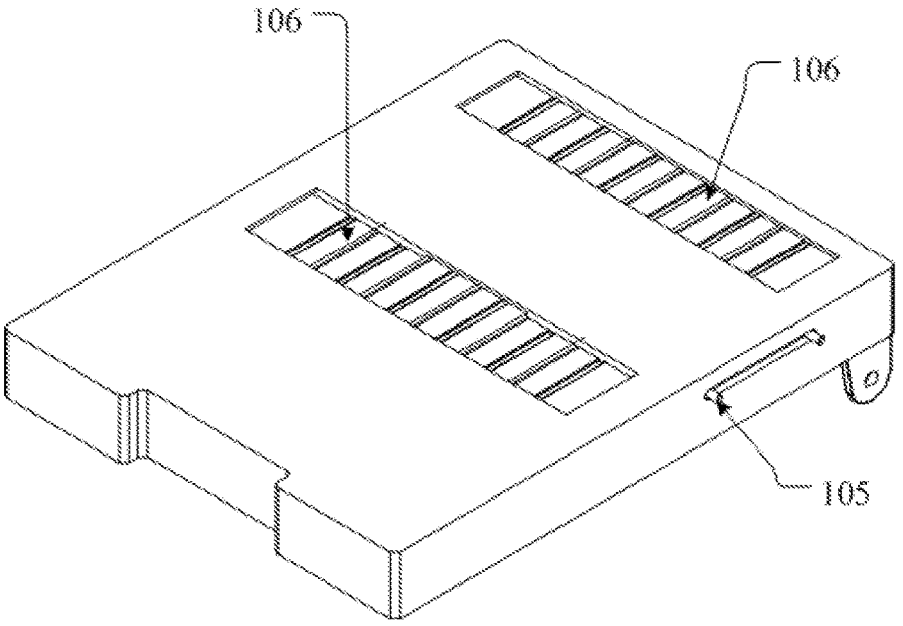
FIG. 2 is a schematic view showing the structure of an upper box body of the banknote recycling box.

Referring to FIG. 2, the upper box body 102 is provided with a banknote entrance door 106 for ensuring the safety of the banknote recycling box. The banknote entrance door 106 is connected to a lever 105 and controlled by the lever 105. When the banknote recycling box is inserted into a lower passage of a banknote processing device of an automatic teller machine, the lever 105 comes into contact with a pushing rod of a frame of the banknote processing device and then the lever 105 is triggered to open the banknote entrance door 106.

Figure 3:
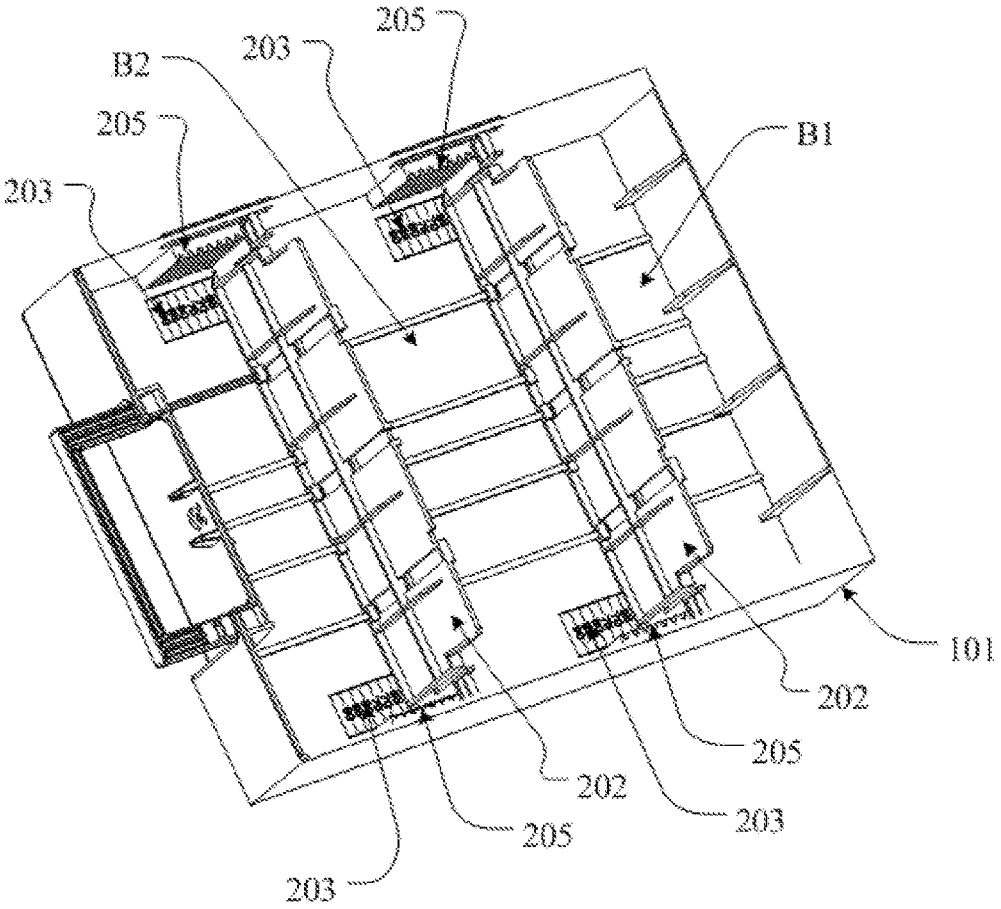
FIG. 3 is a schematic view showing the structure of a lower box body of the banknote recycling box.
Figure 4:
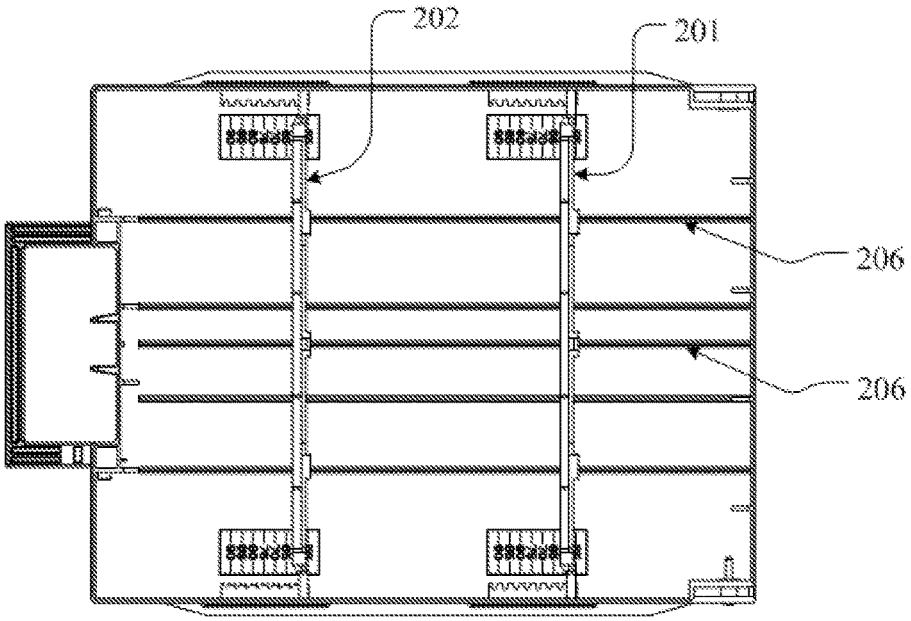
FIG. 4 is a top view of FIG. 3.

Reference is made to FIGS. 3 and 4 which show an interior structure of the banknote recycling box according to this embodiment. Partition plates 201 and 202 divide an interior of the banknote recycling box into two storage regions B1 and B2, which are respectively used to store waste banknotes and banknotes forgotten by clients. An inner wall of the box body is provided with vertical groove groups 205 at the left and the right of the partition plates, and the vertical groove groups 205 are provided for fixing the respective partition plates. Each vertical groove group 205 includes multiple vertical grooves. The vertical grooves at the left and at the right are symmetrical to each other. The partition plate 201 can be inserted into different vertical grooves to respectively adjust the sizes of the spaces B1 and B2. A bottom of the banknote recycling box is provided with a label 203 for indicating the width of the banknote to which the storage space adapts. Multiple label numbers may be provided on the label 203 to represent different banknote widths. For example, a label number 70 represents that a banknote with a width of 70 can be stored.

Figure 5:
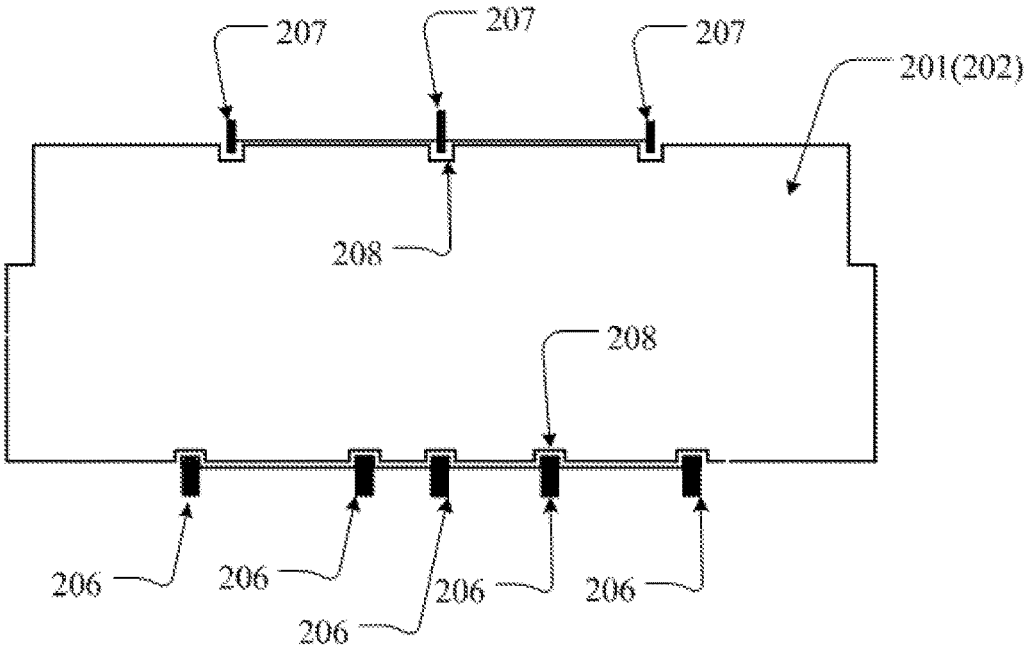
FIG. 5 is a schematic view showing the structure of ribs and grooves of a partition plate.
Figure 6:
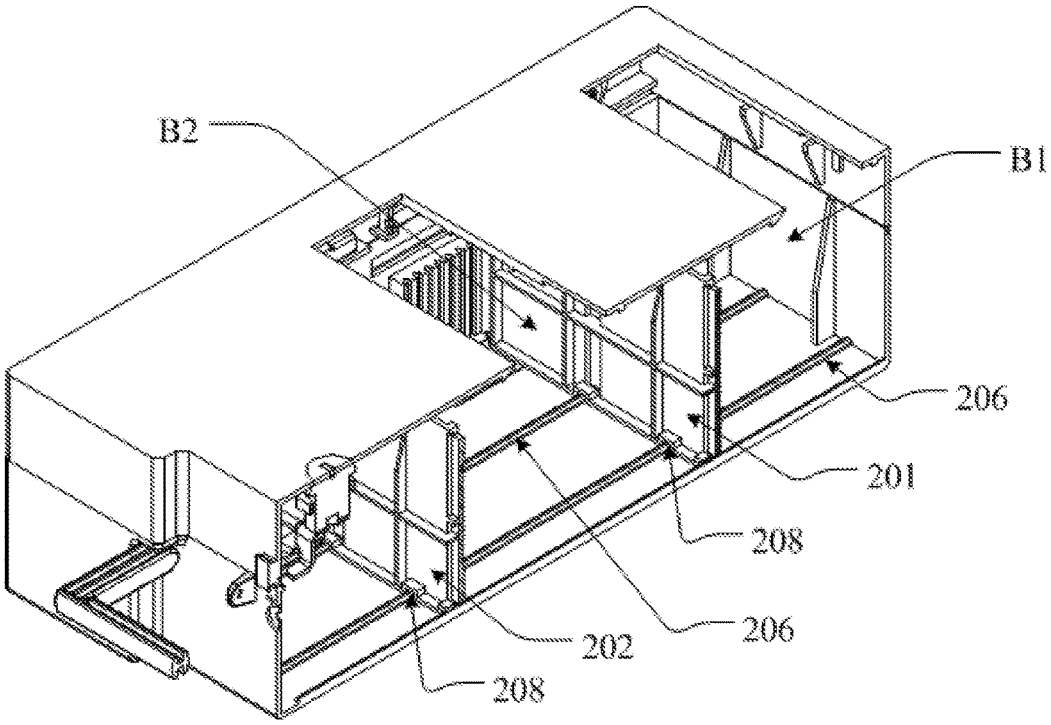
FIG. 6 is a sectional schematic view showing the banknote recycling box according to an embodiment of the present application.

Referring to FIGS. 5 and 6, a rib 207 is provided on an inner wall of the upper box body of the banknote recycling box, and an upper edge of each of the partition plates 201 and 202 is provided with a groove 208 corresponding to the rib 207. During the installation, the rib 207 is inserted into the corresponding groove 208, and in this case, the rib 207 and the groove 208 are overlapped in the space, and thus the banknote can be prevented from entering an adjoining space and the banknote in one storage region can be prevented from entering the other storage region. Similarly, a rib 206 is provided on an inner wall of the lower box body of the banknote recycling box, and a lower edge of each of the partition plates 201 and 202 is also provided with a groove 208 corresponding to the rib 206. During the installation, the rib 206 is inserted into the corresponding groove 208, and in this case, the rib 206 and the groove 208 are overlapped in the space, and thus the banknote can be prevented from entering an adjoining space and the banknote in one storage region can be prevented from entering the other storage region. It should be noted that, as shown in FIG. 5, the positions of lower ribs 206 may be not symmetrical in the left and right direction, to prevent the partition plate from being mistakenly installed.

Figure 7:
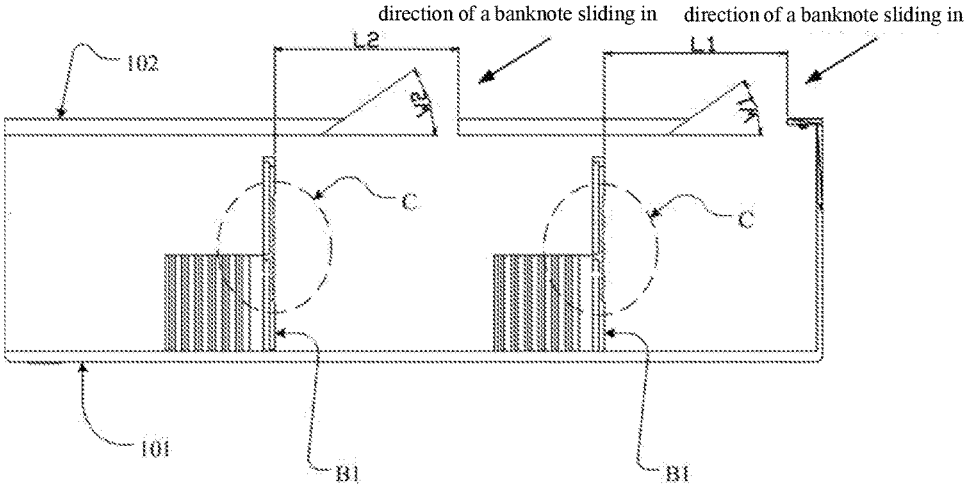
FIG. 7 is a schematic view showing that a banknote slides into the banknote recycling box.

Reference is made to FIG. 7 which shows a positional relationship between entering angles W1 and W2 of the banknotes at entrances (the waste banknote entrance 103 or the forgotten banknote recycling entrance 104) and widths L1 and L2 between the partition plates and the respective entrances. The entrance chamfering angles W1 and W2 may have a best appropriate value according to the size of the banknote recycling box. In this embodiment, the entering angles W1 and W2 can be embodied as an angle about 30 degrees, to effectively prevent the banknote from inclining and erecting in the banknote recycling box. The widths L1 and L2 may respectively correspond to the widths of the banknotes to be stored. After the banknote slides in from the entrance, a front end of the banknote will come into contact with a tooth-shaped portion C on the partition plate. The zigzag structure of the tooth-shaped portion C brings a great friction force to the front end of the banknote, and thus the front end of the banknote is stopped when it continually moves downwardly, and under the action of inertia and gravity, a rear end of the banknote moves downward. When the rear end of the banknote is level with the front end of the banknote or is lower than the front end of the banknote, the front end of the banknote is driven by the rear end to leave the tooth-shaped portion C. In this time, the banknote being in an approximate horizontal state continues to move downward and enters the bottom of the storage region. Therefore, the tooth-shaped portion C on the partition plate prevents a situation that the banknotes are erected and stacked disorderly when the front ends of the entered banknotes contact the bottom of the storage region firstly.

In this embodiment, a banknote recycling box includes a box body (including an upper box body 102 and a lower box body 101) and a partition plate 201 installed in the box body. A Left inner wall and a right inner wall of the box body are provided with symmetrical vertical groove groups 205, and each of the vertical groove groups 205 includes multiple vertical grooves. A left edge and a right edge of the partition plate 201 are inserted into the vertical grooves, to divide an inner space of the box body. In this embodiment, the position of the partition plate 201 in the box body may be adjusted by inserting the partition plate 201 in different vertical grooves in the vertical groove group 205, and therefore the spaces of a waste banknote portion and a forgotten recycling portion (B1 and B2) in the banknote recycling box can be adjusted. And, after a banknote with a small size enters a suitable storage space after being adjusted, no gap will occur in the storage space, thereby avoiding a situation that subsequent banknotes are inclined and erected when enter the storage space, and banknotes are disorderly stacked or jammed.

Figure 8:
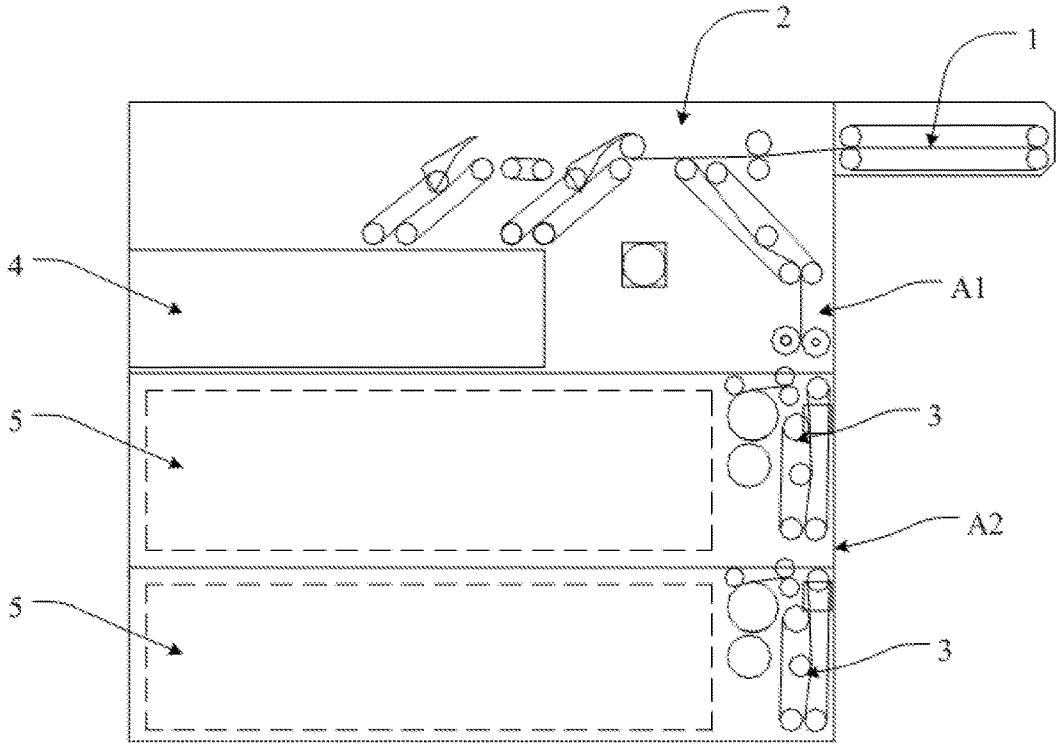
FIG. 8 is a schematic view showing the structure of a banknote processing device according to an embodiment of the present application.

As shown in FIG. 8, a banknote processing device is further provided according to an embodiment of the present application. The banknote processing device generally includes an upper module A1 and a lower module A2. The upper module A1 is mainly consisted of a banknote inlet/outlet 1, a banknote conveying passage 2, and a banknote recycling box 4, etc. The lower module A2 is mainly consisted of a lower conveying passage 3 and a banknote box 5, etc. The banknote recycling box 4 is any one of the banknote recycling boxes illustrated in FIGS. 1 to 7.

It can be clearly understood by the person skilled in the art that, for convenience and conciseness of description, the detailed work processes of the above-mentioned system, device and unit may refer to a corresponding process in the above-mentioned method embodiments, which will not be described herein.

In conclusion, the above embodiments only intend to illustrate the technical solutions of the present application, and are not intended to limit the technical solutions of the present application. Though the present application has been described in detail with reference to the above embodiments, it should be understood by the person skilled in the art that, modifications may be made to the technical solutions described in the above various embodiments, or equivalent substitutions may be made to a part of the technical features in the above embodiments; and all these modifications or substitutions do not make the essence of the respective technical solutions depart from the spirit and scope of the technical solutions of the embodiments of the present application.

What is claimed is:

1. A banknote recycling box, comprising a box body and a partition plate installed in the box body, wherein, a left inner wall and a right inner wall of the box body are provided with symmetrical vertical groove groups, and each of the vertical groove groups comprises a plurality of vertical grooves; and a left edge and a right edge of the partition plate are inserted into the vertical grooves to divide an inner space of the box body; and wherein, one side of the partition plate is provided with a tooth-shaped area, and tooth-shaped structures of the tooth-shaped area are parallel to a bottom of the box body; and wherein, the box body is divided into an upper box body and a lower box body;

inner walls of the upper box body and the lower box body are both provided with ribs; and an upper edge and a lower edge of the partition plate are provided with grooves configured to cooperate with the respective ribs.

2. The banknote recycling box according to claim 1, wherein, a label is provided at a position adjoining to each of the vertical groove groups, and the label is marked with a corresponding relationship between the respective vertical groove of the vertical groove group and a width of a banknote.

3. The banknote recycling box according to claim 1, wherein the number of the partition plate is two.

4. The banknote recycling box according to claim 1, wherein, the ribs of the upper box body are asymmetrically arranged in a left and right direction;

or, the ribs of the lower box body are asymmetrically arranged in the left and right direction.

5. The banknote recycling box according to claim 1, wherein a plurality of inner spaces in the box body divided by the partition plate are not in communication with each other.

6. The banknote recycling box according to claim 1, wherein a top of the box body is provided with a plurality of banknote entrances.

7. The banknote recycling box according to claim 6, wherein, a banknote entrance door is provided on the banknote entrance; and one side of the box body is provided with a lever, and the lever is connected to the banknote entrance door and is configured to open the banknote entrance door when the lever is trigged.

8. A banknote processing device, comprising a banknote inlet, a banknote conveying passage, a lower conveying passage and a plurality of banknote boxes, wherein the banknote processing device further comprises the banknote recycling box according to claim 1.

9. The banknote processing device according to claim 8, wherein a label is provided at a position adjoining to each of the vertical groove groups, and the label is marked with a corresponding relationship between the respective vertical groove of the vertical groove group and a width of a banknote.

10. The banknote processing device according to claim 8, wherein the number of the partition plate is two.

11. The banknote processing device according to claim 8, wherein the ribs of the upper box body are asymmetrically arranged in a left and right direction;

or, the ribs of the lower box body are asymmetrically arranged in the left and right direction.

12. The banknote processing device according to claim 8, wherein a plurality of inner spaces in the box body divided by the partition plate are not in communication with each other.

13. The banknote processing device according to claim 8, wherein a top of the box body is provided with a plurality of banknote entrances.

14. The banknote processing device according to claim 13, wherein a banknote entrance door is provided on the banknote entrance; and one side of the box body is provided with a lever, and the lever is connected to the banknote entrance door and is configured to open the banknote entrance door when the lever is trigged.

* * * * *